US008286716B2

(12) United States Patent
Martinez et al.

(10) Patent No.: US 8,286,716 B2
(45) Date of Patent: Oct. 16, 2012

(54) LOW STRESS TRACTION SYSTEM

(75) Inventors: Ruben Martinez, Houston, TX (US); Max E. Spencer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/205,108

(22) Filed: Sep. 5, 2008

(65) Prior Publication Data

US 2009/0071660 A1 Mar. 19, 2009

Related U.S. Application Data

(60) Provisional application No. 60/973,596, filed on Sep. 19, 2007.

(51) Int. Cl.
*E21B 23/00* (2006.01)

(52) U.S. Cl. ..... 166/382; 166/217; 166/216

(58) Field of Classification Search ..... 166/382, 166/217, 212
See application file for complete search history.

(56) References Cited

U.S. PATENT DOCUMENTS

| | | | | |
|---|---|---|---|---|
| 2,874,783 | A | 2/1959 | Haines | |
| 3,603,391 | A | 9/1971 | Yann | |
| 4,212,352 | A * | 7/1980 | Upton | 166/206 |
| 4,941,532 | A | 7/1990 | Hurt et al. | |
| 4,971,146 | A | 11/1990 | Terrell | |
| 5,451,084 | A * | 9/1995 | Jansch | 294/1.1 |
| 6,311,778 | B1 * | 11/2001 | Carisella et al. | 166/382 |
| 6,464,003 | B2 | 10/2002 | Bloom et al. | |
| 6,640,894 | B2 | 11/2003 | Bloom et al. | |
| 6,715,559 | B2 | 4/2004 | Bloom et al. | |
| 6,796,380 | B2 | 9/2004 | Xu | |
| 6,892,811 | B2 | 5/2005 | LaClare et al. | |
| 7,048,047 | B2 | 5/2006 | Bloom et al. | |
| 7,278,482 | B2 | 10/2007 | Azar | |
| 2006/0289172 | A1 | 12/2006 | Miller et al. | |
| 2008/0264627 | A1 * | 10/2008 | Roberts et al. | 166/118 |

FOREIGN PATENT DOCUMENTS

| | | |
|---|---|---|
| RU | 2245986 | 2/2005 |
| RU | 62156 | 3/2007 |
| WO | 0066877 A | 11/2000 |

OTHER PUBLICATIONS

Russian Official Action dated Feb. 9, 2012, Application No. 2010115348, filed Sep. 17, 2008.

* cited by examiner

*Primary Examiner* — William P Neuder
*Assistant Examiner* — Yong-Suk Ro
(74) *Attorney, Agent, or Firm* — Michael Flynn; Jody DeStefanis; Charlotte Rutherford

(57) ABSTRACT

A technique enables anchoring of a tool in a wellbore. The technique provides traction against a well component without creating high stress concentrations that weaken the well component. An anchoring device comprises anchoring members that are selectively movable to an expanded configuration for anchoring the tool. The anchoring members have traction surfaces able to selectively engage a smooth anchoring surface of the well component at any desired location along the well component. Each traction surface is formed to facilitate traction while minimizing stress concentration.

25 Claims, 4 Drawing Sheets

LOW STRESS TRACTION SYSTEM

CROSS-REFERENCE TO RELATED APPLICATION

The present document is based on and claims priority to U.S. Provisional Application Ser. No. 60/973,596, filed Sep. 19, 2007.

BACKGROUND

Many types of well related operations rely on traction in a wellbore to secure a device at a desired position during the well related operation. One method of establishing traction is through static friction. Mating materials are selected which tend to have large coefficients of friction when mated together. An example of a device that employs static friction to support a large force is a slat-reinforced inflatable packer. A slat-reinforced inflatable packer is constructed with an inner, inflatable element covered by metal reinforcing slats. When the inner element is inflated, the metal slats are pressed against an inside surface of a pipe in which the packer is installed. Friction between the slats and the pipe provides the traction required to secure the packer.

In other well applications, packers are employed with well completions and include slips that are pressed into a casing wall with wedges. The slips have sharp ridges specifically designed to be embedded into the surface of the well casing to better establish traction. In other designs, the slips incorporate very hard materials that press sharp features into the well casing to establish traction. However, use of such devices tends to weaken the well casing by creating high stress concentrations where the well casing is deformed with the sharp features of the packer slips. The sharp features and high stress concentrations also tend to create regions that rapidly initiate corrosion.

SUMMARY

In general, the present invention provides a system and method for providing traction against an anchoring surface of a well component without creating high stress concentrations that weaken the well component. An anchoring device comprises anchoring members that are movable between a contracted configuration and an expanded configuration. The anchoring members have traction surfaces able to selectively engage a smooth surface of the well component at any desired location along the well component. Each traction surface is formed to facilitate traction while minimizing stress concentration.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for anchoring a tool in a wellbore. The system and methodology utilize a device for supporting a large traction force at the surface of a component, e.g. an inner surface of a well tubular, with which the device is in contact. The device is able to provide a very large level of traction per unit of contact area, while minimizing the detrimental effect on the strength and corrosion resistance of the component with which it is in contact.

In one embodiment, the device comprises one or more traction surfaces having protruding traction features designed to press into an anchoring surface, such as an interior surface of a well tubular, to generate traction. In many applications, the component against which the traction surface is pressed is a metal component. The traction surface is designed to minimize the damaging nature of the imprint left on the anchoring surface of the well component.

The traction surfaces are generally designed with traction features protruding from a base portion. The traction features can be in the form of gentle curvilinear transitions to different height levels along the traction surface. For example, the traction features may comprise protrusions with smooth curvilinear shapes having predetermined curvatures selected to provide smooth indentations in a surrounding tubular member upon activation of the anchoring device. Gentle or smooth curvilinear shapes/transitions can refer to features having sufficiently low curvature to prevent formation of sharp or angular deformation features in the adjacent anchoring surface when the traction features are pressed against the anchoring surface.

In one embodiment, the traction surfaces comprise protrusions shaped so the portions of the protrusions that deform the anchoring surface are smooth and generally convex. By using traction surfaces, such as those described above, the indentations left in the anchoring service are smooth and minimize impairment to the strength of the component, e.g. well tubular, to which the anchoring device is anchored. The shape of the indentations minimizes the stress concentration factor and also creates a smoother finish that renders the anchoring surface more resistant to the initiation of corrosion.

Figure 1:
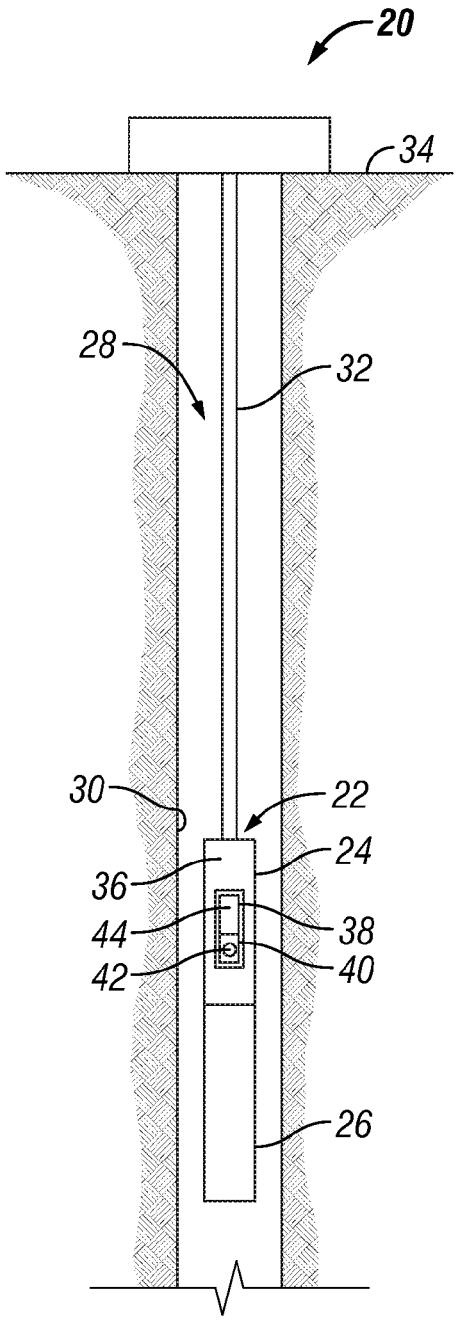
FIG. 1 is a schematic front elevation view of an anchoring system deployed in a wellbore, according to an embodiment of the present invention.

Referring generally to FIG. 1, one embodiment of a well system 20 is illustrated as having an anchoring system 22 comprising an anchoring tool 24. In this embodiment, anchoring tool 24 is connected to a well tool 26 which may have a variety of forms depending on the specific well application in which well tool 26 and anchoring tool 24 are utilized. For example, well tool 26 may comprise a tool string for performing a variety of downhole operations. Well tool 26 also may comprise a variety of individual components, such as a completion tool, a well treatment tool, or a variety of other tools deployed downhole to perform the desired operation.

In the embodiment illustrated, anchoring tool 24 and well tool 26 are deployed downhole into a wellbore 28 within a well tubular 30, which may comprise a well casing, production tubing or other tubular structure. In many applications, the well tubular is formed from steel or another metal material. A conveyance 32, such as coiled tubing, production tubing, wireline, slickline, or another suitable conveyance is used to deploy the anchoring tool 24 and well tool 26 into wellbore 28 from a surface location 34.

The anchoring tool 24 comprises a structure 36 and a plurality of movable members 38 that move relative to structure 36 between a radially contracted configuration and a radially expanded, anchoring configuration. Each movable member 38 comprises a traction region or traction pad 40 having a traction surface 42 designed to engage a smooth anchoring surface, such as the inside surface of well tubular 30. The traction surface 42 securely holds anchoring tool 24 when the anchoring tool is actuated while minimizing the stress concentration factor associated with the imprint left on the inside surface of the wellbore tubular 30. The traction surface 42 also creates a smoother anchor imprint surface that is more resistant to the initiation of corrosion. In the embodiment illustrated in FIG. 1, the movable members 38 are constructed as anchoring arms 44 which can pivot between a radially contracted configuration and a radially expanded configuration that anchors tool 24 to the surrounding well tubular 30.

Figure 2:
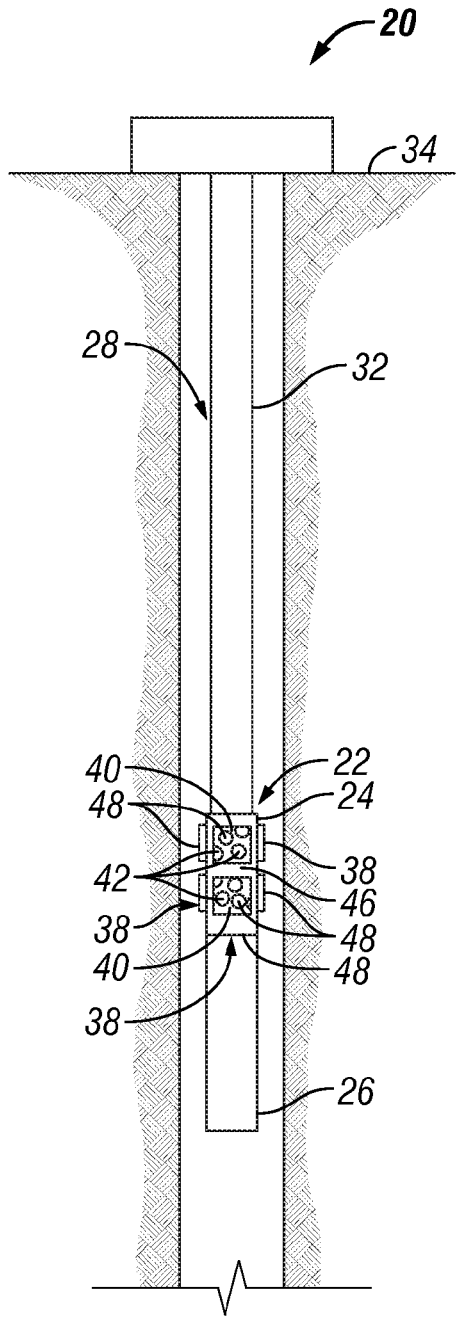
FIG. 2 is a schematic front elevation view of another anchoring system deployed in a wellbore, according to an alternate embodiment of the present invention.

Another embodiment of well system 20 is illustrated in FIG. 2. In this embodiment, well system 20 comprises anchoring tool 24 in the form of a packer 46 that can be set at any location along well tubular 30. The movable members 38 comprise packer slips 48 which can be actuated between a radially contracted configuration and a radially expanded configuration that anchors packer 46 to the surrounding well tubular 30. The packer slips 48 are formed as, or with, traction pads 40 having the traction surfaces 42 designed to selectively secure packer 46 within tubular 30 while minimizing the stress concentration factor and also creating a smoother anchoring surface that is more resistant to the initiation of corrosion. As described with respect to the embodiment illustrated in FIG. 1, a variety of well tools 26 can be used with one or more packers 46.

Figure 3:
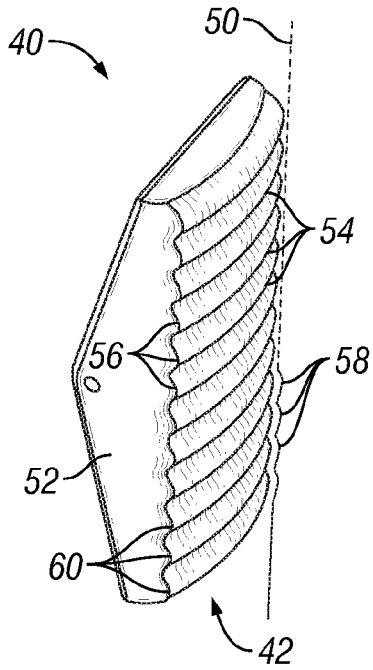
FIG. 3 is an orthogonal view of a traction pad having a traction surface, according to an embodiment of the present invention.

Referring generally to FIG. 3, one example of a traction pad 40 is illustrated as deployed along an anchoring surface 50 of, for example, well tubular 30. The traction pad 40 comprises a base portion 52 on which traction surface 42 is formed or mounted. Traction surface 42 comprises one or more traction features 54 that provide traction surface 42 with changes in height formed by gentle curvilinear transitions 56. The transitions 56 facilitate traction with anchoring surface 50 while minimizing stress concentration that would otherwise weaken the well component having surface 50.

The traction pad 40 can be used to secure a well tool at a fixed location in, for example, an oil well. For example, one or more traction pads 40 can be used to fix the position of well tool 26 in production tubing, well casing, or other tubular components used in wellbore 28. The traction pad 40 is pressed against anchoring surface 50 with sufficient force to create smooth depressions or deformations 58 that enable a substantial traction force during use of well tool 26. However, the traction surface 42 and the gentle curvilinear transitions 56 of traction features 54 ensure that the formation of smooth deformations 58 limit the stress concentration and the potential for corrosion or other damage along anchoring surface 50. The smooth deformations also reduce the likelihood that delicate components, such as elastomeric seals, are damaged during subsequent deployments through the well tubular 30.

In the specific example illustrated in FIG. 3, traction features 54 are formed as smooth undulations that create deformations 58 in the form of similarly smooth, corresponding undulations along anchoring surface 50. However, the deformations 58 can comprise smooth, corresponding undulations according to other traction features 54 and may include, for example, spherical deformations. In the embodiment of FIG. 3, the smooth undulations are created by a series of ridges 60 formed along traction surface 42 of traction pad 40. The traction pad 40 also may comprise a variety of mounting features, such as a pivot that allows articulating motion of traction pad 40 once mounted on anchoring tool 24. In the embodiments described below and illustrated in FIGS. 5-9, for example, a mounting feature 62 is used for pivotably mounting traction pad 40. In some embodiments, a plurality of traction pads 40 may be constructed as packer slips 48 for use as part of packer 46. In other embodiments, the traction pads 40 can be mounted on a variety of other types of movable members 38, such as anchoring arms 44.

Figure 4:
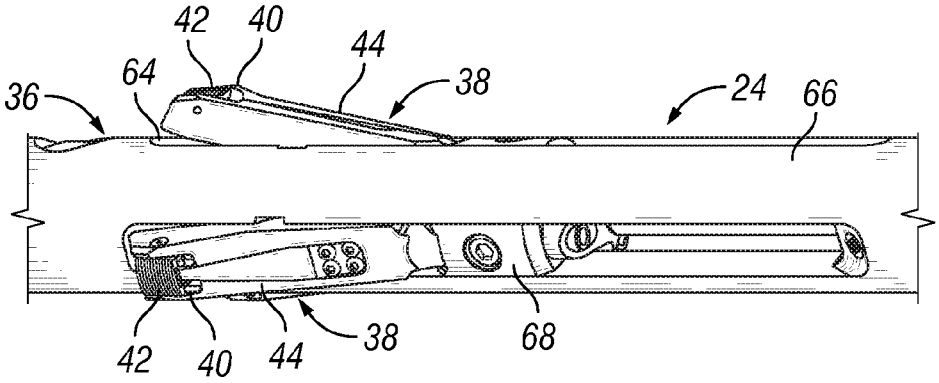
FIG. 4 is an orthogonal view of one example of an anchoring tool, according to an embodiment of the present invention.

For example, one embodiment of anchoring tool 24 is illustrated in FIG. 4 as utilizing a plurality of traction pads 40. In the embodiment of FIG. 4, the traction pads 40 are mounted on movable members 38, which are constructed as pivoting anchor arms 44. The anchoring arms 44 are illustrated as transitioned at least partially in a radially outward direction toward engagement with anchoring surface 50, however the anchoring arms can be retracted into corresponding recesses 64 to allow movement of anchoring tool 24 down through tubular 30 and through potentially restricted regions. In the example illustrated, structure 36 comprises a body 66 having the corresponding recesses 64 sized to receive individual anchoring arms 44. When the arms 44 are in a radially contracted/closed configuration, the arms are contained within the envelope of the tool body 66. Containment of the anchor arms 44 ensures the arms do not limit the ability of anchoring tool 24 to pass through restrictions and also prevents the arms from causing tool 24 to become caught on features during deployment or retrieval of the anchoring tool. By way of example, body 66 may comprise a cylindrical body.

Upon actuation of anchoring tool 24 to an anchoring configuration, the plurality of arms 44 is moved radially outward with respect to structure 36/tool body 66 until traction surface 42 is pressed into anchoring surface 50. In the particular example illustrated, the anchoring arms are pivotably mounted to a pivot base 68 that allows the arms 40 to pivot between the radially inward and outward positions.

Figure 5:
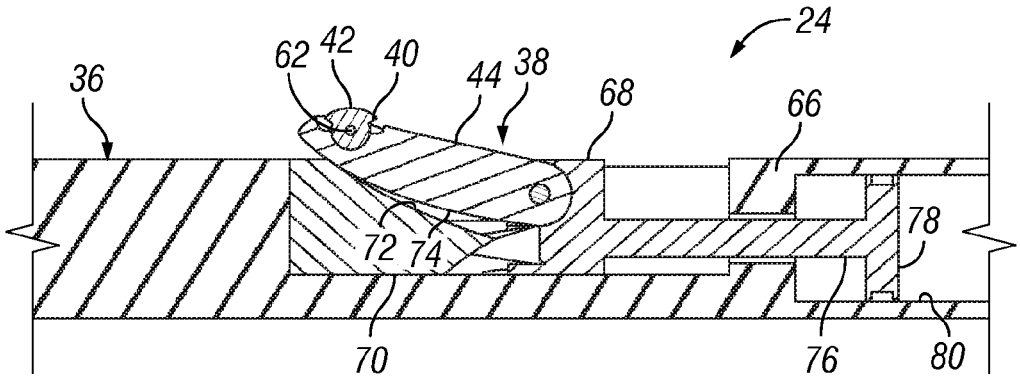
FIG. 5 is a cross-sectional view of one example of an anchoring tool, according to an embodiment of the present invention.

Referring generally to the axial cross-sectional view of FIG. 5, a more detailed example of one embodiment of anchoring tool 24 is illustrated. In this example, a wedge component 70 is mounted in structure 36 and oriented to interact with the plurality of anchor arms 44. The wedge component 70 comprises a plurality of wedge features 72 disposed to interact with corresponding features 74 of each anchoring arm 44. The corresponding features 74 are located to engage the wedge features 72 during relative movement of wedge component 70 and the plurality of anchoring arms 44. One or both of the wedge component 70 and the plurality of arms 44 can be axially movable to cause the interaction and resultant radial movement of arms 44.

In the example illustrated in FIG. 5, the plurality of anchoring arms 44 is axially movable relative to wedge component 70 by virtue of forming pivot base 68 as a movable pivot base. The actuation of anchoring tool 24 to the radially outward, anchoring configuration is caused by moving pivot base 68 in an axial direction toward wedge component 70. During the axial movement, wedge features 72 engage corresponding features 74 and force each arm 44 to pivot in a radially outward direction, as illustrated in FIG. 5. Continued movement of pivot base 68 and anchoring arms 44 toward wedge component 70 causes continued radially outward movement of the plurality of arms 44 until the arms 44 engage the anchoring surface 50 to anchor well tool 26. Relative axial movement of the wedge component 70 away from arms 44 causes, or at least allows, the arms 44 to pivot radially inward to the contracted configuration.

Relative axial movement of the wedge component 70 and the plurality of anchoring arms 44 can be achieved by a variety of mechanisms. One or more actuators can be coupled to the plurality of anchoring arms 44 and/or the wedge component 70 to induce the desired, relative axial movement. For example, an actuator 76 can be connected to pivot base 68 to move the plurality of anchoring arms 44 with respect to wedge component 70. The actuator 76 may comprise a hydraulic actuator, an electro-mechanical actuator, or other suitable actuators. By way of example, the actuator 76 comprises a hydraulic piston 78 movably mounted within a piston chamber 80 for selected movement under the influence of hydraulic pressure. However, other implementations of actuator 76 may comprise a variety of hydraulic, mechanical, electric, electromechanical, and other suitable actuators able to cause the relative axial motion which transitions anchoring tool 24 between contracted configurations and expanded, anchoring configurations.

Figure 6:
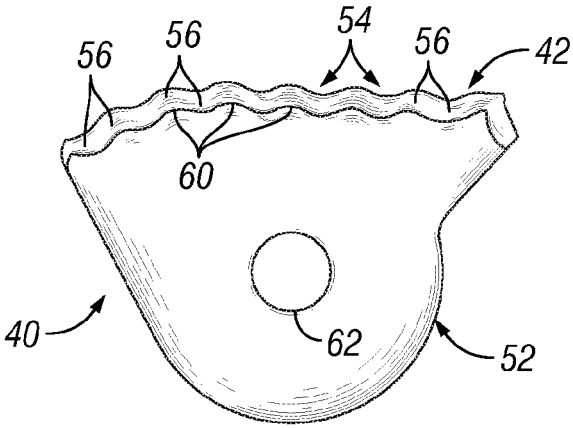
FIG. 6 is a side view of a traction pad that can be used with an anchoring tool, according to an embodiment of the present invention.
Figure 7:
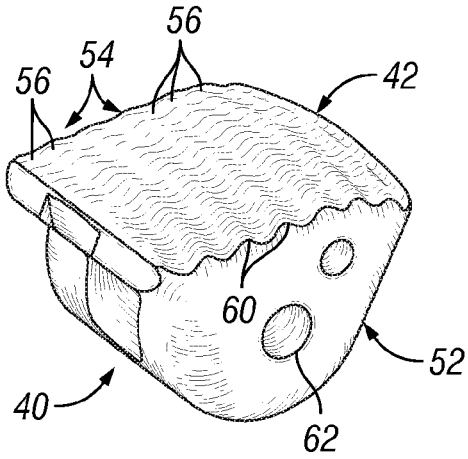
FIG. 7 is an orthogonal view of the traction pad illustrated in FIG. 6, according to an embodiment of the present invention.

In FIGS. 6 and 7, another embodiment of traction pad 40 is illustrated. This type of traction pad 40 is suitable for pivotable mounting at an end of each anchoring arm 44. However, the traction pads 40 also can be used in a variety of other anchoring tools, including packers utilizing anchoring slips. In this example, the traction pad 40 is formed as a pivoting or articulating pad by virtue of the pivotable mounting structure 62 formed in base portion 52. The design presents traction surface 42 in an orientation that moves the traction surface 42 into engagement with anchoring surface 50 when anchoring tool 24 is actuated to a radially expanded configuration for anchoring well tool 26.

In the embodiment illustrated in FIGS. 6 and 7, traction surface 42 again comprises one or more traction features 54 that provide traction surface 42 with undulations having the gentle curvilinear transitions 56. The transitions 56 facilitate traction with anchoring surface 50 while minimizing stress concentrations that lead to weaknesses and increased corrosion. The smooth undulations are arranged to create the ridges 60 which form corresponding depressions or deformations 58 when tool 24 is actuated to an anchoring configuration.

Figure 8:
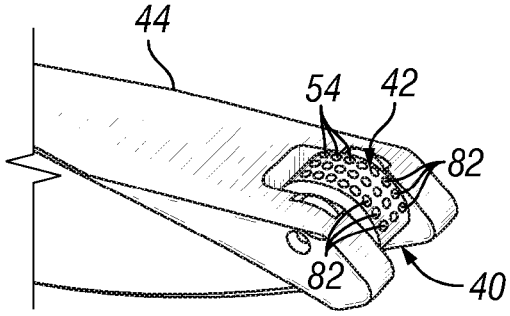
FIG. 8 is an orthogonal view of a movable member having a traction pad, according to an alternate embodiment of the present invention.
Figure 9:
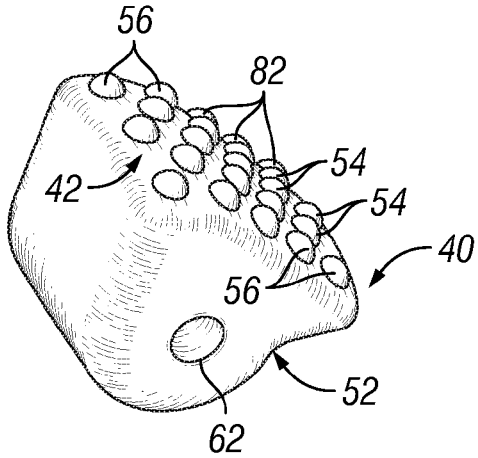
FIG. 9 is an orthogonal view of a traction pad, according to an alternate embodiment of the present invention.

Referring generally to FIGS. 8 and 9, another embodiment of traction pad 40 is illustrated. As best shown in FIG. 8, this embodiment of traction pad 40 is well-suited for being mounted as an articulating pad in anchoring arm 44. However, the structure of traction pad 40 and its traction surface 42 can be adjusted for use with a variety of anchoring mechanisms including packer 46.

In the embodiment of FIGS. 8 and 9, the traction surface 42 is once again formed with gentle curvilinear transitions 56. The transitions 56 facilitate traction with anchoring surface 50 while minimizing stress concentrations that can lead to weaknesses and increased corrosion. The gentle curvilinear transitions 56 are arranged in a different pattern, however, to create one or more curved protrusions 82. In the example illustrated, traction surface 42 comprises a plurality of curved protrusions 82. In one example, the protrusions 82 comprise portions of a sphere to create generally spherical protrusions that engage anchoring surface 50 without creating any sharp, angular deformations that would otherwise result in high stress concentrations. However, the curved protrusions can have other forms comprising substantially spherical shapes, ellipsoidal shapes, or other shapes or combinations of shapes that do not create sharp, angular deformations.

Figure 10:
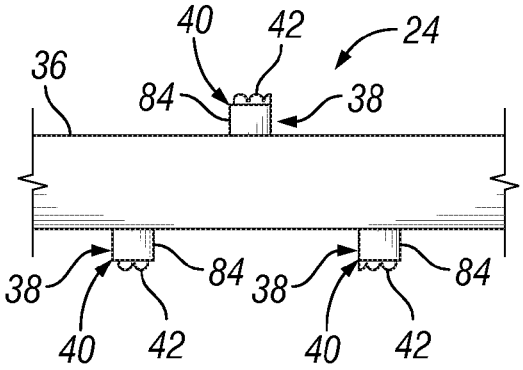
FIG. 10 illustrates another example of an anchoring tool, according to an alternate embodiment of the present invention.

The traction pads 40 and traction surfaces 42 can be utilized in a variety of anchoring tools 24 having many types of movable members 38. In the alternate embodiment illustrated in FIG. 10, for example, the movable members 38 are formed as extensible pistons 84 that can be moved radially with respect to structure 36 between the radially contracted configuration and the radially expanded, anchoring configuration. The radially extensible pistons 84 can be moved hydraulically, electrically, or by other suitable systems.

Anchoring system 22 can be used in a variety of well systems and in a variety of well applications and environments. The anchoring tool 24 can be constructed in several configurations for use with traction pads 40 having a variety of sizes, shapes, mounting structures, and overall configurations. Additionally, the traction surface of each traction pad can be adjusted, as long as the traction surface is able to provide a substantial traction force without deforming the cooperating anchoring surface in a manner that leads to high stress concentrations, weakening of the anchoring component, and/or increased corrosion.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for supporting a large traction force in a tubular member disposed in a wellbore, comprising:

an anchoring device comprising a structure, a plurality of movable members mounted for radial movement with respect to the structure, and a traction pad mounted to each movable member, the traction pad comprising:

a base portion; and a plurality of traction features protruding from the base portion, the plurality of traction features, the plurality of traction features defining smooth curvilinear outer edges for engagement with the tubular member, the edges having a predetermined curvature selected to provide smooth indentations in the tubular member upon an anchoring of the anchoring device with respect to the tubular member caused by engaging the smooth curvilinear outer edges of the plurality of traction features against the tubular member.

2. The system as recited in claim 1, wherein the plurality of movable members comprises a plurality of packer slips.

3. The system as recited in claim 1, wherein the plurality of movable members comprises radially extensible pistons.

4. The system as recited in claim 1, wherein the plurality of movable members comprises a plurality of pivoting arms, and wherein the pivoting arms are actuated by an axially movable wedge component, resulting in radial movement of the pivoting arms.

5. The system as recited in claim 1, wherein each traction pad comprises an articulating traction pad.

6. The system as recited in claim 1, wherein the plurality of traction features having smooth curvilinear outer edges together form a plurality of gently curved ridges.

7. The system as recited in claim 1, wherein the plurality of traction features comprises a plurality of unique protrusions.

8. The system as recited in claim 7, wherein each unique protrusion of the plurality of unique protrusions comprises a portion of a sphere.

9. A method for anchoring in a wellbore, comprising:

actuating an anchoring device to move anchor members radially outward and into contact with an inside surface of a well tubular to anchor and fix the anchor members with respect to the well tubular; and forming outer surfaces of the anchor members into base portions having predetermined smooth and convex curvilinear surfaces protruding therefrom such that anchoring the anchor members with respect to the well tubular causes a plurality of smooth depressions to be formed in the inside surface of the well tubular without creating an undue stress concentration in the inside surface of the well tubular.

10. The method as recited in claim 9, wherein actuating comprises moving a plurality of packer slips in the tubular.

11. The method as recited in claim 9, wherein actuating comprises moving a plurality of pivotable anchoring arms in the tubular.

12. The method as recited in claim 9, wherein the plurality of smooth depressions form a series of smooth undulations along the inside surface of the well tubular.

13. The method as recited in claim 9, wherein forming comprises forming one or more substantially spherically shaped depressions along the inside surface.

14. The method as recited in claim 9, further comprising mounting an articulating traction pad on each anchor member; and orienting the articulating traction pad to form the plurality of smooth depressions.

15. The method as recited in claim 9, further comprising connecting the anchoring device to a well tool.

16. A device to facilitate anchoring in a tubular structure, comprising:

a traction pad having traction features comprising smooth curvilinear outer edges protruding from the traction pad with predetermined smooth curvatures to create smooth deformations and prevent formation of angular deformation features in a surrounding tubular when anchored against the surrounding tubular.

17. The device as recited in claim 16, wherein the traction pad comprises an articulation mount.

18. The device as recited in claim 16, wherein the traction pad is supported by a wireline conveyance assembly.

19. The device as recited in claim 16, wherein the traction features together form a smooth undulating surface.

20. The device as recited in claim 16, wherein the traction feature comprises one or more substantially spherically shaped protrusions.

21. A method, comprising:

constructing an anchoring device with a plurality of anchoring members movable between a radially contracted configuration and a radially expanded anchoring configuration;

providing each anchoring member with a traction surface able to selectively engage an anchoring surface of a well component; and forming the traction surface with predetermined gentle curvilinear smooth cuter edge transitions between changes in height protruding from the traction surface to facilitate an anchoring of each anchor member with the anchoring surface while minimizing a stress concentration on the anchoring surface and while fixing the traction surface relative to the anchoring surface.

22. The method as recited in claim 21, further comprising connecting the anchoring device to a well tool.

23. The method as recited in claim 22, further comprising moving the anchoring device and the well tool downhole through a well tubular.

24. The method as recited in claim 23, further comprising actuating the anchoring device within the well tubular.

25. The method as recited in claim 21, wherein providing comprises providing each anchoring member with an articulating traction pad having the traction surface.

* * * * *